United States Patent [19]

Catte

[11] Patent Number: 5,052,893

[45] Date of Patent: Oct. 1, 1991

[54] STOP MEANS AND SEALING RING OF A BLADE ASSEMBLY MOUNTED ON A GAS-TURBINE-ENGINE ROTOR-DISK

[75] Inventor: Philippe P. Catte, Chennevieres, France

[73] Assignee: Societe Nationale d'Etude et de Construction de Moteurs d'Aviation "S.N.E.C.M.A.", Paris, France

[21] Appl. No.: 543,717

[22] PCT Filed: Nov. 16, 1989

[86] PCT No.: PCT/FR89/00588

§ 371 Date: Jul. 17, 1990

§ 102(e) Date: Jul. 17, 1990

[87] PCT Pub. No.: WO90/05837

PCT Pub. Date: May 31, 1990

[30] Foreign Application Priority Data

Nov. 17, 1988 [FR] France ..... 88 14913

[51] Int. Cl.[5] ..... F01D 5/30

[52] U.S. Cl. ..... 416/220 R; 416/221

[58] Field of Search ..... 416/220 R, 221, 219 R

[56] References Cited

U.S. PATENT DOCUMENTS

| | | | |
|---|---|---|---|
| 2,998,959 | 9/1961 | Haworth et al. | 416/221 |
| 3,853,425 | 12/1974 | Sealzo et al. | 416/220 R |
| 4,247,257 | 1/1981 | Benoist et al. | 416/221 |
| 4,845,821 | 8/1989 | Kernon et al. | 416/220 R |

FOREIGN PATENT DOCUMENTS

| | | |
|---|---|---|
| 1158244 | 6/1958 | France . |
| 2324873 | 4/1977 | France . |
| 2603333 | 3/1988 | France . |
| 905583 | 9/1962 | United Kingdom . |

*Primary Examiner*—John T. Kwon

*Attorney, Agent, or Firm*—Bacon & Thomas

[57] ABSTRACT

A device for locking the blade roots (3) in rotor disk alveoli (2) consists of a single split ring (9) with a Y shaped cross-section of which a radial upstream arm (9*a*) is inserted in the groove (7) of the downstream blade lips (6) the radial downstream arm (9*b*) of the ring (9) being pressed against the downstream part of the blade lips (6).

7 Claims, 1 Drawing Sheet

STOP MEANS AND SEALING RING OF A BLADE ASSEMBLY MOUNTED ON A GAS-TURBINE-ENGINE ROTOR-DISK

BACKGROUND OF THE INVENTION

The present invention concerns gas-turbine-engine rotors and, more particularly, axial-locking means for the blades mounted in axial openings on the disk periphery.

When the rotor-blades of gas turbine engines are fastened in axial openings—that is, openings extending parallel to the axis of the gas-turbine engine, or slightly apart from a parallel to the axis of the gas turbine engine, two assembly problems do arise.

A first problem is to achieve the simplest possible locking of each blade, but also in the most reliable manner, and in such a way that disassembly of a blade or of the entire set may also be simplified.

The second problem concerns the hermeticity between the upstream and downstream sides of a disk and is crucial for the gas-turbine-engine compressors. If the spaces between the alveolar bottoms of the disk and the blade roots are not suitably masked, substantial downstream air volume may pass under the blade roots and recirculate to the compressor upstream side, whereby its compression ratio shall be lowered and the overall efficiency of the gas-turbine engine shall be prohibitively degraded.

French patent document A 2,603,333 in the name of applicant describes a gas-turbine-engine rotor, in particular for aviation purposes, which comprises at least one disk bearing a set of blades of which the roots are mounted in broached alveoli along the disk periphery and along an axis parallel with or slightly inclining to a parallel to the longitudinal engine axis. The blade roots are equipped with a means for wedging the blades onto the upstream disk side and with a rear lip fitted with a transverse groove radially pointing to the disk axis, the disk itself comprising a circular groove radially pointing to its periphery. The rotor includes a means for locking the blades axially downstream on the disk while simultaneously the hermeticity between said blade roots and the disk's alveolar bottoms is assured, said means for locking the blades downstream onto the disk consisting of two split rings of which the first at least cooperates simultaneously with the grooves of the blade lips and the circular disk groove, the sum of the thicknesses of the first and second rings being equal to the thickness of the grooves of the blade lips.

This document represents the state of the art transcended by the present invention.

In this prior art, the blades required a groove deep and wide enough to receive the two rings.

As regards gas turbine engines presently the object of research, illustratively turbojet engines with rapid propellers for which the compressor rotors evince very small diameters, the height underneath the platforms must be minimized and mass gains must be realized with respect to the compressor blades, and the above solution is inapplicable because too bulky.

SUMMARY OF THE INVENTION

Accordingly it is the object of the present invention to substitute a single, integral ring implementing the two functions of locking and sealing for the prior double ring design.

Therefore the object of the invention is a gas-turbine-engine rotor of the type discussed above which is characterized in that the locking means is a single, split ring of Y shaped cross-section where one radially external, upstream arm is inserted in the grooves of the downstream spoilers of the blades and the disk, the radially external downstream arm of the ring being forced against the downstream part of the spoilers of the blades.

BRIEF DESCRIPTION OF THE DRAWINGS

Other features shall be discussed in relation to the attached drawing.

DETAILED DESCRIPTION OF THE PREFERRED EMBODIMENTS

Figure 1:
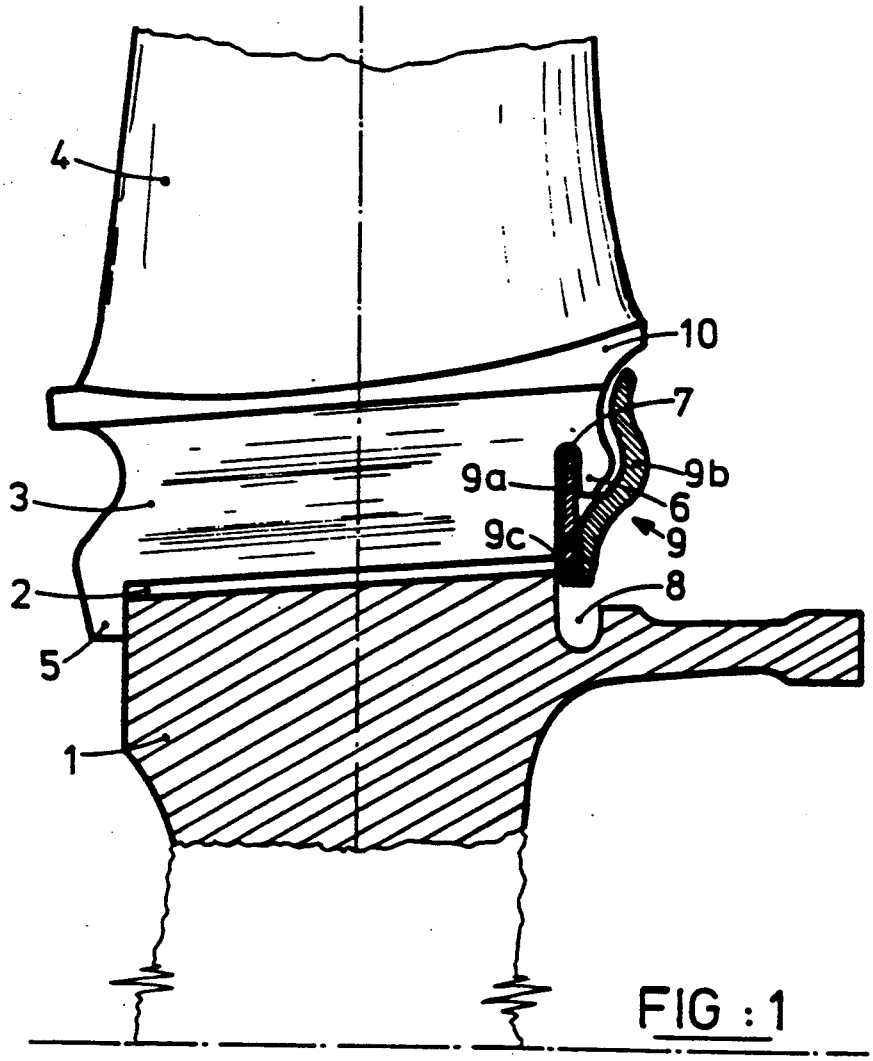
FIG. 1 is a partial cross-sectional view of a rotor stage of a gas turbine engine equipped with a first embodiment of locking means of the invention.

In FIG. 1 the rotor disk defines essentially axial alveoli 2 into which are inserted the roots 3 of blades 4 fitted with an upstream fixing means 5 on the upstream side of the disk 1 and a downstream lip 6 having a transverse groove 7 pointing radially to the disk axis. The disk is provided with a groove 8 opposite the blade groove 7, groove 8 pointing radially to its periphery and being used in assembly/disassembly.

A split ring 9 with a Y shaped cross-section of which the asymmetric arms **9*a* and 9*b* are joined by their common stem 9*c* is inserted into the groove 7. The flat upstream arm 9*a* is inserted into the groove 7**.

The downstream arm **9*b* is longer than the arm 9*a* and is curved so as to hug the downstream shape of the lip 6 and rises to below the blade platform 10**.

When being manufactured, the two arms **9*a* and 9*b* may be made slightly tight so that when the ring is put in place, the downstream arm shall be pressed against the downstream side of lip 6**. Also, when in operation the pressure P from between the upstream and the downstream sides of the disk in combination with the centrifugal force increases the compression of the downstream arm against the blade.

In the variation shown in FIG. 1, the ring is made by welding together the radially inner parts of two annular metal sheets of which the upstream one is flat and the downstream one is curved.

Figure 2:
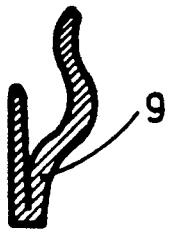
FIG. 2 is a cross-sectional view of a second embodiment of the locking ring.

In the embodiment variation of FIG. 2, the ring is made by bending and forming a single annular metal sheet of which the bend constitutes the stem of the Y shaped cross-section of the ring.

Figure 3:
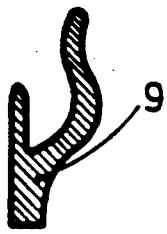
FIG. 3 is a cross-sectional view of a third embodiment of said ring.

In the embodiment shown in FIG. 3, the ring is made by machining around an integral, annular blank.

When comparing this solution with that in the above cited French patent document A2,603,333, it will be noted that in said document, the blades would be required to define a wide groove to receive two rings whereas in the present invention, with the hermeticity having been assigned to the downstream arm of the ring, the required groove in the blade roots is only of minimal width.

Accordingly the two functions of hermeticity and axial locking of the blades on the disk can be achieved as well as in the past but while saving material and space for the blades.

The ring is assembled by emplacing the ring stem 9c in the groove 8 and by radially compressing the ring so that the upstream arm 9a shall be below the lip 6. Once pressed forward, the ring may be released radially whereby the upstream arm 9a enters the groove 7. In operation, the ring shall be kept in the groove 7 by centrifugal force.

The advantage so secured allows reducing the dimensions of gas-turbine-engine rotors, or, in a different light, to use split-ring, effective locking on rotors with lesser diameters.

I claim:

1. Locking means for locking blade roots onto a rotor for a gas-turbine engine, especially for aviation, having at least one rotor disk bearing a set of blades of which the roots are mounted in alveoli defined in the disk periphery along an axis generally parallel to a longitudinal engine axis, the blade roots (3) having a fixing means (5) keeping the blades one the upstream side of the disk (1) and a downstream lip (6) with a transverse groove (7) radially pointing to the disk axis, a means locking the blades axially downstream on the disk being inserted into said groove (7) and simultaneously assuring hermeticity between the blade roots (3) and the bottoms of the alveoli (2) of the disk, the disk in turn being provided with a circular groove (8) pointing radially toward its periphery, wherein the locking means comprises: a single split ring (9) having a generally Y shaped cross-section having a first generally radial upstream arm (**9*l*) adapted to be inserted into the groove (7) of the downstream lips (6) of the blade and the disk (1), and a second generally radial downstream arm (9*b*) of the ring (9) adapted to be pressed against a downstream part of the blade lips (6**).

2. The locking means for a gas-turbine-engine rotor defined in claim 1, wherein the second, downstream arm (**9*b*) of the ring is curved so as to match the shape of the downstream part of the blade lips (6**).

3. The locking means for a gas-turbine-engine rotor defined in claim 1 wherein the second, downstream arm (**9*b*) of the ring is longer than the first upstream arm (9*a***) and extends to below the blade platform.

4. The locking means for a gas-turbine-engine rotor defined in claim 1 wherein the ring is formed so that its first and second radial arms (**9*a*, 9*b***) slightly resilient to assure firm locking of the blades onto the disk and improve hermeticity.

5. The locking means for a gas-turbine-engine rotor defined in claim 1 wherein the ring (9) is made from sheetmetal.

6. The locking means for a gas-turbine-engine rotor defined in claim 1 wherein the first and second radial arms are formed separately and are welded together at a radially inner location.

7. The locking means for a gas-turbine-engine rotor defined in claim 1 wherein the ring is made by machining an integral metal blank.

* * * * *

UNITED STATES PATENT AND TRADEMARK OFFICE

CERTIFICATE OF CORRECTION

PATENT NO. : 5,052,893

DATED : October 1, 1991

INVENTOR(S) : Catte

It is certified that error appears in the above-identified patent and that said Letters Patent is hereby corrected as shown below:

Col. 2, line 24, after "disk" insert --1--;
line 51, after "embodiment" delete "variation".

Col. 3, line 19, change "one" to "on".

Col. 4, line 1, change "(91)" to "(9a)".

Signed and Sealed this

Twenty-first Day of June, 1994

*Attest:*

Bruce Lehman

BRUCE LEHMAN

*Attesting Officer*

*Commissioner of Patents and Trademarks*